US006158064A

United States Patent [19]

Downs

[11] Patent Number: 6,158,064

[45] Date of Patent: Dec. 12, 2000

[54] WATER LEVEL ADJUSTMENT DEVICE

[76] Inventor: Maurice George Downs, 407 Ferndale Blvd., Islip, N.Y. 11751

[21] Appl. No.: 09/263,269

[22] Filed: Mar. 5, 1999

[51] Int. Cl.[7] ..... E04H 4/00

[52] U.S. Cl. ..... 4/508; 4/507

[58] Field of Search ..... 4/508, 507, 625; 137/428, 563

[56] References Cited

U.S. PATENT DOCUMENTS 2,809,752 10/1957 Leslie ..... 4/508
3,908,206 9/1975 Grewing ..... 4/172.17
4,240,606 12/1980 Johnson ..... 251/127
4,373,220 2/1983 Selsted ..... 4/508
5,655,232 8/1997 Buckwalter ..... 4/508

*Primary Examiner*—Steven O. Douglas
*Assistant Examiner*—Huyen Le
*Attorney, Agent, or Firm*—Goldstein & Canino

[57] ABSTRACT

A water level adjustment device including a reservoir positioned within a hole formed adjacent to an in-ground swimming pool. The reservoir has an opening therein for coupling with a water supply line. An outlet pipe extends between the reservoir and the swimming pool. The outlet pipe is disposed below the water supply line. A water shut-off valve is coupled with the water supply line inwardly of the reservoir.

1 Claim, 3 Drawing Sheets

FIG 1
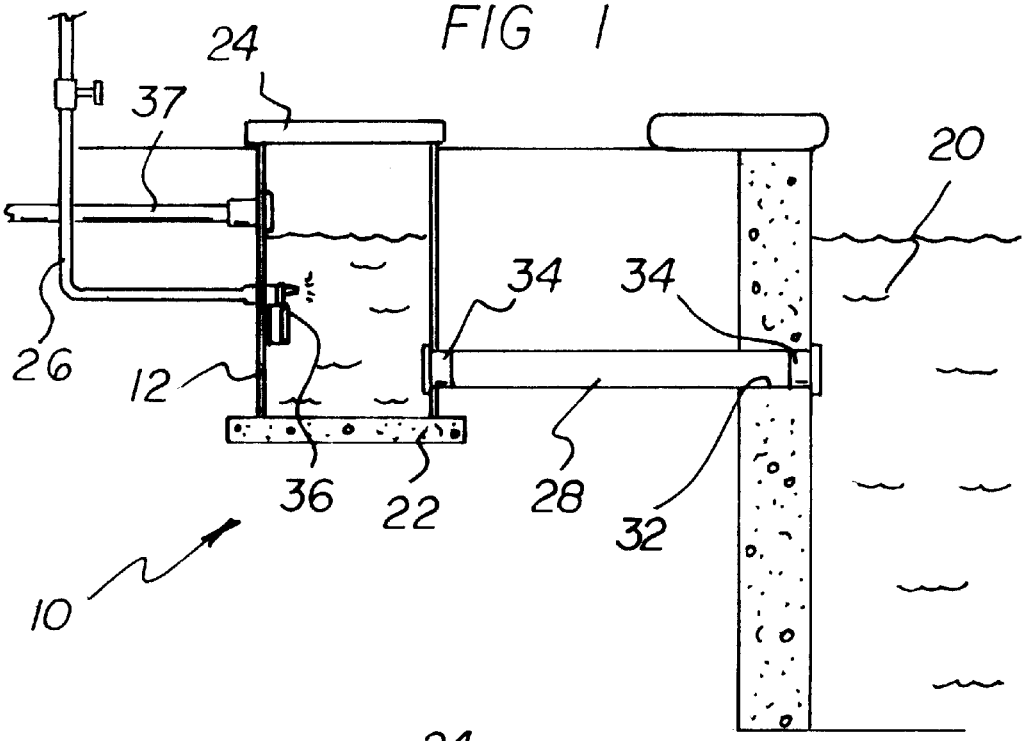
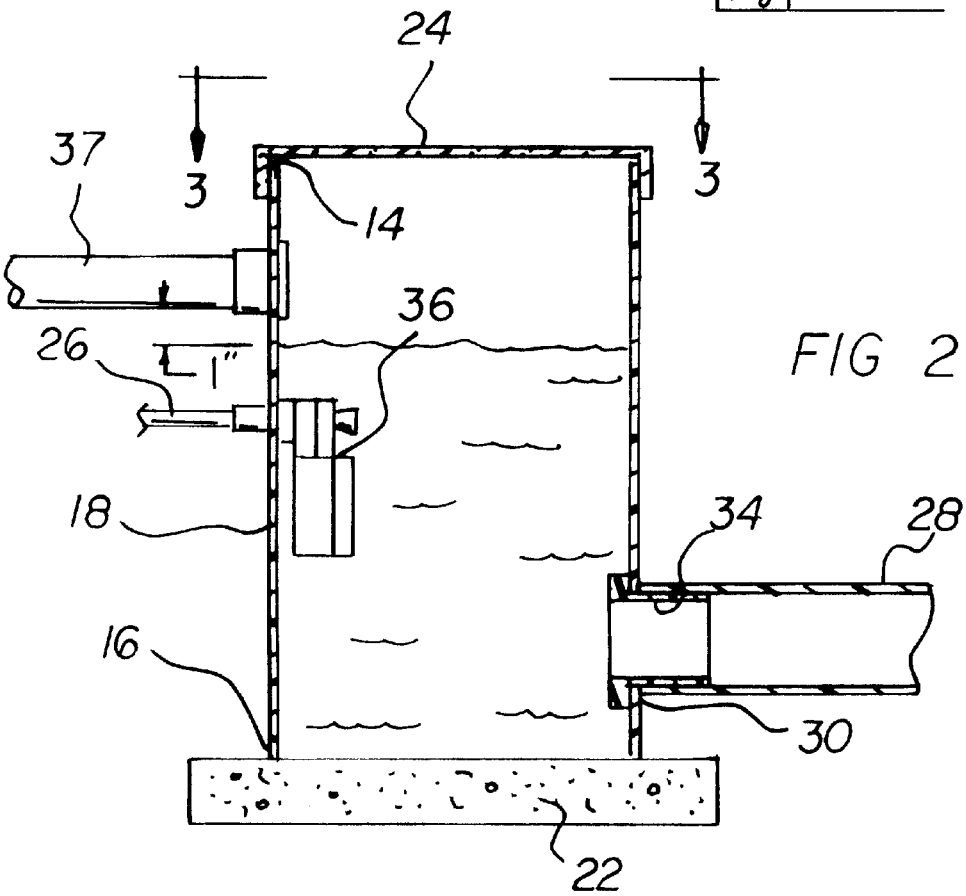
FIG 2

WATER LEVEL ADJUSTMENT DEVICE

BACKGROUND OF THE INVENTION

The present invention relates to a water level adjustment device and more particularly pertains to automatically adding water to or removing water from a swimming pool when it falls below or rises above a predetermined level.

The use of water level control devices is known in the prior art. More specifically, water level control devices heretofore devised and utilized for the purpose of adjusting water levels are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,574,405 to Tams; U.S. Pat. No. 4,972,530 to Snyder; and U.S. Pat. No. 5,203,038 to Gibbs.

While these devices fulfill their respective, particular objective and requirements, the aforementioned patents do not describe a water level adjustment device for automatically adding water to a swimming pool when it falls below or rises above a predetermined level.

In this respect, the water level adjustment device according to the present invention substantially departs from the conventional concepts and designs of the prior art, and in doing so provides an apparatus primarily developed for the purpose of automatically adding water to a swimming pool when it falls below a predetermined level or removing water once it rises above a predetermined level.

Therefore, it can be appreciated that there exists a continuing need for new and improved water level adjustment device which can be used for automatically adding or removing water to a swimming pool when it falls below or rises above a predetermined level. In this regard, the present invention substantially fulfills this need.

SUMMARY OF THE INVENTION

In the view of the foregoing disadvantages inherent in the known types of water level control devices now present in the prior art, the present invention provides an improved water level adjustment device. As such, the general purpose of the present invention, which will be described subsequently in greater detail, is to provide a new and improved water level adjustment device and method which has all the advantages of the prior art and none of the disadvantages.

To attain this, the present invention essentially comprises a reservoir having a generally square configuration. The reservoir has an open upper end, a closed lower end, and a square side wall therebetween. The reservoir is positioned within a hole formed adjacent to an in-ground swimming pool. The reservoir is positioned atop a concrete slab. The open upper end has an opaque cover removably disposed thereover. The square side wall has an opening therein for coupling with a water supply line. An outlet pipe extends between the reservoir and the swimming pool. The outlet pipe is disposed below the water supply line. The outlet pipe has an inner end extending inwardly of an opening in the square side wall of the reservoir essentially diametrically opposed from the water supply line. The outlet pipe has an outer end extending inwardly of a side wall of the swimming pool. The inner end and the outer end each are fitted with standard pool water return fittings. A pressure sensitive water valve is coupled with the water supply line inwardly of the reservoir.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water level adjustment device which has all the advantages of the prior art water level control devices and none of the disadvantages.

It is another object of the present invention to provide a new and improved water level adjustment device which may be easily and efficiently manufactured and marketed.

It is a further object of the present invention to provide a new and improved water level adjustment device which is of durable and reliable construction.

An even further object of the present invention is to provide a new and improved water level adjustment device which is susceptible of a low cost of manufacture with regard to both materials and labor, and which accordingly is then susceptible of low prices of sale to the consuming public, thereby making such a water level adjustment device economically available to the buying public.

Even still another object of the present invention is to provide a new and improved water level adjustment device for automatically adding water to a swimming pool when it falls below a predetermined level or removing water when it rises above a predetermined level.

Lastly, it is an object of the present invention to provide a new and improved water level adjustment device including a reservoir positioned within a hole formed adjacent to an inground swimming pool. The reservoir has an opening therein for coupling with a water supply line. An outlet pipe extends between the reservoir and the swimming pool. The outlet pipe is disposed below the water supply line. A water shut-off valve is coupled with the water supply line inwardly of the reservoir.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the water level adjustment device constructed in accordance with the principles of the present invention.

FIG. 2 is a side view of the water reservoir of the present invention.

The same reference numerals refer to the same parts through the various figures.

DESCRIPTION OF THE PREFERRED EMBODIMENT

Figure 3:
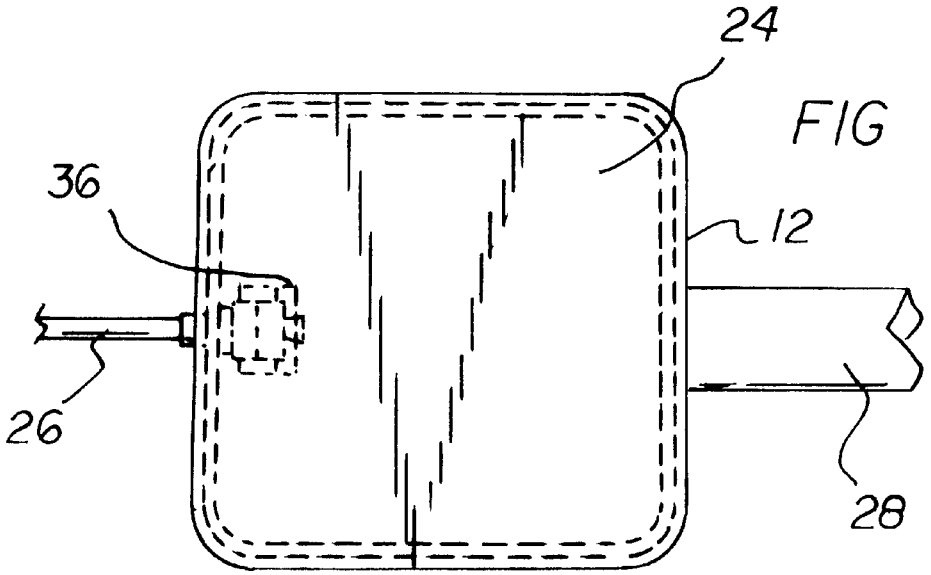
FIG. 3 is a top plan view of the water reservoir as taken along line 3—3 of FIG. 2.

With reference now to the drawings, and in particular, to FIGS. 1 through 5 thereof, the preferred embodiment of the new and improved water level adjustment device embodying the principles and concepts of the present invention and generally designated by the reference number 10 will be described.

Specifically, it will be noted in the various Figures that the device relates to a water level adjustment device for automatically adding water to a swimming pool when it falls below a predetermined level or removing water once it rises above a predetermined level. In its broadest context, the device consists of reservoir, an outlet pipe, a pressure sensitive water valve, and a drain pipe. Such components are individually configured and correlated with respect to each other so as to attain the desired objective.

The reservoir 12 has a generally square configuration. The reservoir 12 has an open upper end 14, a closed lower end 16, and a square side wall 18 therebetween. The reservoir 12 is positioned within a hole formed adjacent to an in-ground swimming pool 20. The reservoir 12 is positioned atop a concrete slab 22. The open upper end 14 has an opaque cover 24 removably disposed thereover. The cover 24 is preferably opaque to prevent the build-up of algae thereon. The square side wall 18 has an opening therein for coupling with a water supply line 26.

The outlet pipe 28 extends between the reservoir 12 and the swimming pool 20. The outlet pipe 28 is disposed below the water supply line 26. The outlet pipe 28 has an inner end 30 extending inwardly of an opening in the square side wall 18 of the reservoir 12 essentially diametrically opposed from the water supply line 26. The outlet pipe 28 has an outer end 32 extending inwardly of a side wall of the swimming pool 20. The inner end 30 and the outer end 32 each are fitted with standard swimming pool water return fittings 34.

The pressure sensitive water valve 36 is coupled with the water supply line 26 inwardly of the reservoir 12. The pressure sensitive water valve 36, as illustrated in FIGS. 1 and 2, is set to a specific level with respect to the reservoir 12. Once the water reaches this level, the valve 36 will shut, precluding the entrance of water from the water supply line 26.

The drain pipe 37 extends outwardly from the reservoir 12 at a position above the outlet pipe 28. The drain pipe 37 will serve to drain water from the reservoir 12 once the water level has reached a predetermined level. This will prevent the reservoir 12 and pool from overflowing after heavy rains.

Figure 4:
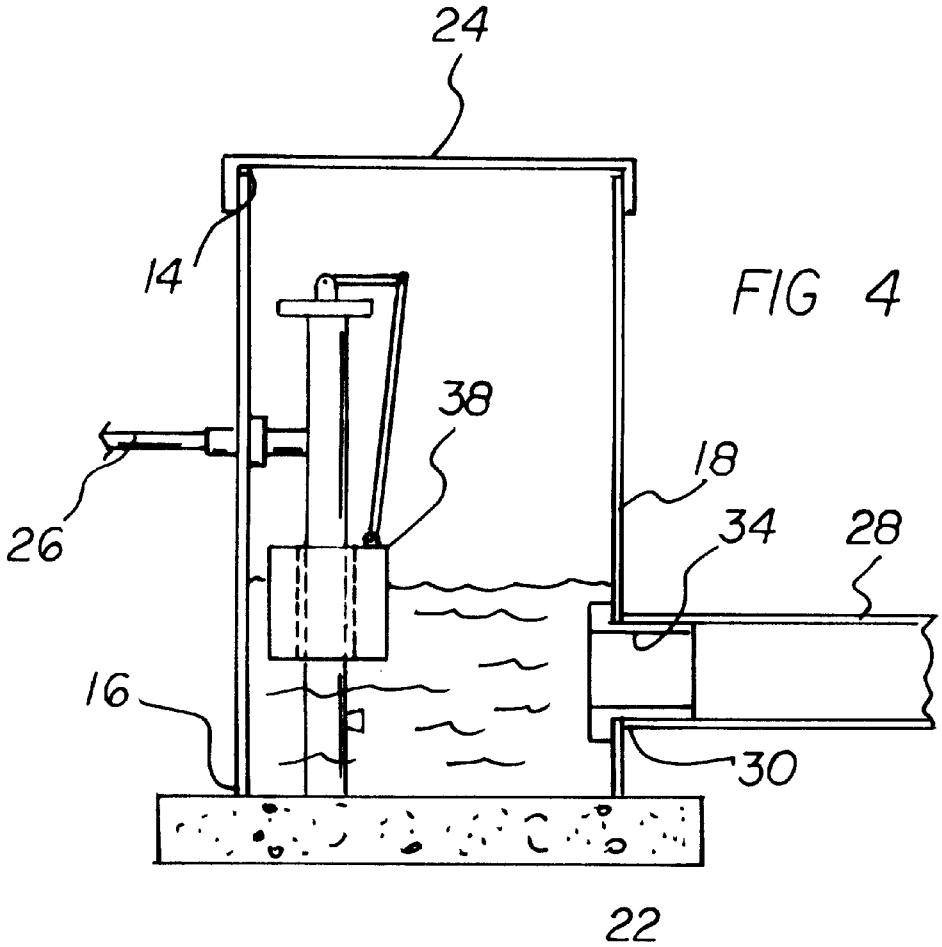
FIG. 4 is a side view of a second embodiment of the present invention.

A second embodiment of the present invention is shown in FIG. 4 and includes substantially all of the components of the present invention further including a conventional floating shut-off valve 38 in place of the pressure sensitive water valve 36. The floating valve 38 is a conventional type known in the plumbing art.

Figure 5:
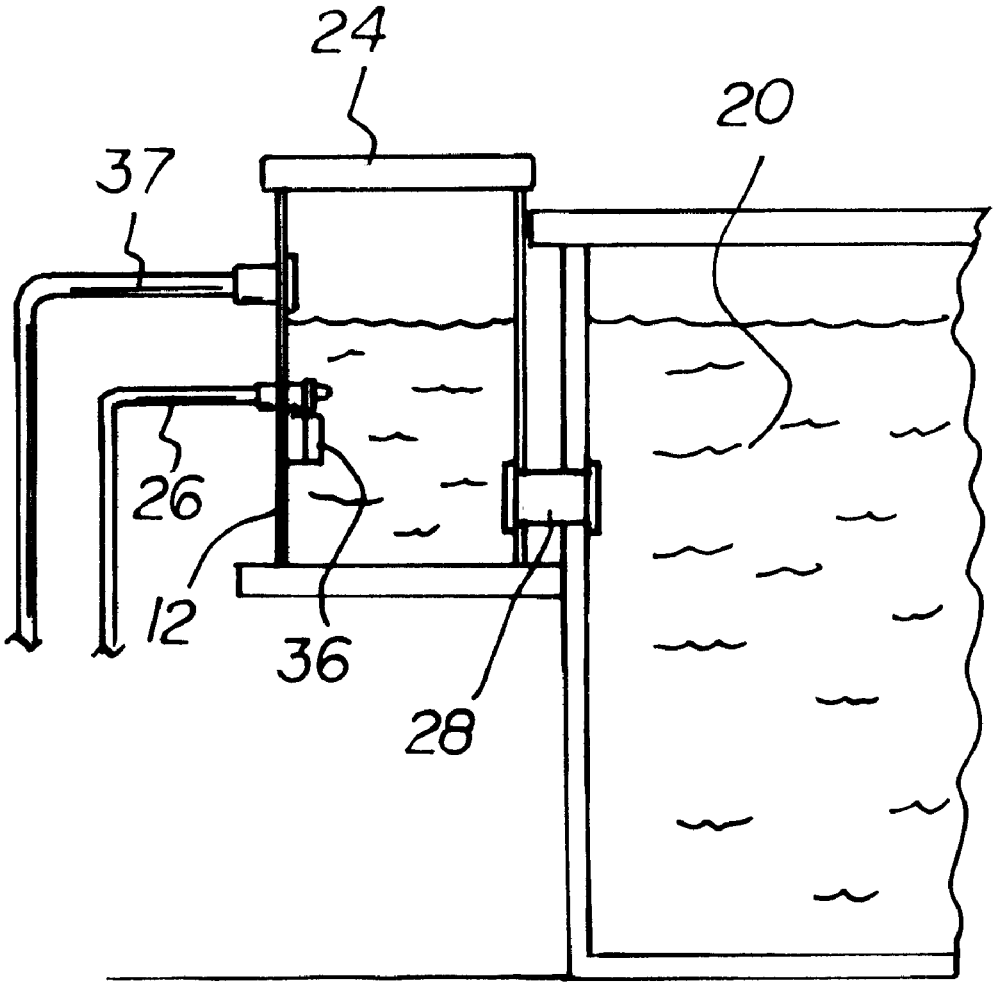
FIG. 5 is a side view of a third embodiment of the present invention.

A third embodiment of the present invention is illustrated in FIG. 5 is particularly an adaption of the present invention for use on above ground swimming pools.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the united states is as follows:

1. A water level adjustment device for automatically adding water to a swimming pool when it falls below a predetermined level and removing water once it rises above a predetermined level comprising, in combination:

a reservoir having a generally square configuration, the reservoir having an open upper end, a closed lower end, and a square side wall therebetween, the reservoir being positioned within a hole formed adjacent to an in-ground swimming pool, the reservoir being positioned atop a concrete slab, the open upper end having an opaque cover removably disposed thereover, the square side wall having an opening therein for coupling with a water supply line;

an outlet pipe extending between the reservoir and the swimming pool, the outlet pipe being disposed below the water supply line, the outlet pipe having an inner end extending inwardly of an opening in the square side wall of the reservoir essentially diametrically opposed from the water supply line, the outlet pipe having an outer end extending inwardly of a side wall of the swimming pool, the inner end and the outer end each being fitted with standard swimming pool water return fittings;

a pressure sensitive water valve coupled with the water supply line inwardly of the reservoir;

a drain pipe extending outwardly from the reservoir at a position above the outlet pipe.

* * * * *